US008677548B2

(12) United States Patent
Jenkyn et al.

(10) Patent No.: US 8,677,548 B2
(45) Date of Patent: Mar. 25, 2014

(54) CURLING HEAD FOR CURLING BROOM

(75) Inventors: Thomas Jenkyn, London (CA); Scott Arnold, London (CA); Jeffrey Wood, London (CA)

(73) Assignee: The University of Western Ontario, London, ON (CA)

( * ) Notice: Subject to any disclaimer, the term of this patent is extended or adjusted under 35 U.S.C. 154(b) by 328 days.

(21) Appl. No.: 13/007,019

(22) Filed: Jan. 14, 2011

(65) Prior Publication Data

US 2011/0167578 A1 Jul. 14, 2011

Related U.S. Application Data

(60) Provisional application No. 61/295,045, filed on Jan. 14, 2010.

(51) Int. Cl.
*A63B 67/14* (2006.01)

(52) U.S. Cl.
CPC ..... *A63B 67/148* (2013.01); *A46B 2200/308* (2013.01)
USPC ..... 15/244.3; 15/210.1; 15/228; 15/160

(58) Field of Classification Search
CPC ... A63B 67/148; A46B 2200/308; A46B 9/02
USPC ..... 15/118, 160, 228, 231, 232, 244.3, 15/220.1
See application file for complete search history.

(56) References Cited

U.S. PATENT DOCUMENTS

| | | | | |
|---|---|---|---|---|
| 1,998,278 | A * | 4/1935 | Halsey | 15/149 |
| 4,070,726 | A * | 1/1978 | Joffre | 15/231 |
| 4,244,074 | A * | 1/1981 | Barcikowski et al. | 15/114 |
| 4,349,933 | A * | 9/1982 | Thompson | 15/118 |
| 6,061,864 | A * | 5/2000 | Ensson | 15/147.1 |
| 7,111,353 | B2 * | 9/2006 | Cowdery | 15/209.1 |
| 7,841,039 | B1 * | 11/2010 | Squire | 15/118 |
| 2004/0031119 | A1 * | 2/2004 | McKay | 15/227 |
| 2005/0000047 | A1 * | 1/2005 | Kelly et al. | 15/104.94 |
| 2005/0039293 | A1 * | 2/2005 | McReynolds et al. | 15/257.05 |
| 2005/0060827 | A1 * | 3/2005 | James et al. | 15/144.2 |
| 2005/0091775 | A1 * | 5/2005 | Lindholm | 15/147.1 |
| 2005/0251943 | A1 * | 11/2005 | Van Landingham | 15/228 |
| 2007/0094829 | A1 * | 5/2007 | Dotterman et al. | 15/228 |

(Continued)

FOREIGN PATENT DOCUMENTS

CA 2279025 4/2009

*Primary Examiner* — Joseph J Hail
*Assistant Examiner* — Marc Carlson
(74) *Attorney, Agent, or Firm* — Lynn C. Schumacher; Hill & Schumacher

(57) ABSTRACT

A curling broom includes an elongate shaft having opposed first and second ends, the first end being graspable by a sweeper and being attached to a broom head attachment plate located at the second end. A curling broom head is attached to the broom head receptacle for sweeping an ice surface. The broom head includes a base section, a reflective constituent selected to reflect infrared radiation which can be a layer secured to a bottom surface of the base section, or the top of the woven fabric or both or a reflective powder incorporated into a foam pad attached to the base section, (or the foam pad being metalized), or an outer surface of an outer fabric layer being metalized and secured to the base section. Infrared radiation generated by sweeping the ice is reflected by the reflective layer back towards the ice surface for further heating the ice surface.

25 Claims, 4 Drawing Sheets

(56) References Cited

U.S. PATENT DOCUMENTS

| | | | | |
|---|---|---|---|---|
| 2008/0016638 | A1* | 1/2008 | Morris et al. | 15/228 |
| 2008/0127994 | A1* | 6/2008 | Rippl et al. | 134/6 |
| 2008/0155775 | A1* | 7/2008 | Damrath et al. | 15/228 |
| 2008/0282489 | A1* | 11/2008 | Monahan et al. | 15/228 |
| 2009/0083926 | A1* | 4/2009 | Boucher | 15/220.1 |
| 2009/0217475 | A1* | 9/2009 | Broman et al. | 15/228 |
| 2010/0031464 | A1* | 2/2010 | Rothweil et al. | 15/231 |

* cited by examiner

CURLING HEAD FOR CURLING BROOM

CROSS REFERENCE TO RELATED U.S. APPLICATIONS

This patent application relates to, and claims the priority benefit from, U.S. Provisional Patent Application Ser. No. 61/295,045 filed on Jan. 14, 2010, in English, entitled CURLING HEAD FOR CURLING BROOM, and which is incorporated herein by reference in its entirety.

FIELD OF THE INVENTION

The present invention relates to a curling broom head for improved ice surface heating and curling performance.

BACKGROUND OF THE INVENTION

Curling brooms influence a curling rock's trajectory as it slides over the ice toward a desired position. The broom or brush is used to 'sweep' or brush the ice immediately in front of the rock to heat the ice surface above the ambient temperature. Sweeping also clears unwanted debris out of the path. By heating the ice surface the friction between the rock and the ice is reduced, making the rock run farther on its current path and straighter. The effectiveness of sweeping depends on the amount by which the ice surface is heated via the friction of the sweeping broom: more heat, more effect.

A curling broom consists of a shaft or handle, a receptacle, and a removable, replaceable head as shown in FIG. 1. The shaft is held by the curler during the sweeping motion and the broom head contacts the ice. The head is most commonly attached to the receptacle via two bolts and threaded holes, bolts and nuts, or hook and loop. The broom head is most commonly constructed on a base that is usually made of plastic (FIG. 2) many other materials including wood may also be used. The base may be many shapes from round to triangular including wings that give a boomerang appearance. A common type current being used is an ovoid with a long axis of approximately 220 mm, short axis of approximately 65 mm and thickness of 10 mm. The underside of the base has a layer of foam which may be bonded in place. This foam layer is for shock absorption and for spreading the head pressure evenly over the ice surface. This can be made to various thicknesses ranging from 2 mm to 50 mm depending on the preference of the player, or there may be no foam layer at all. The foam may be in layers or combined with other materials. Some embodiments have more than one type of foam in various densities and thicknesses. The geometry of the foam can be simply flat or a more complex three dimensional surface with protrusions, indents or gaps. Over the foam is a layer of woven fabric, most often Cordura nylon or other synthetic, polymeric weave. The fabric can be of any colour or pattern. The fabric may be stapled to the top-side of the base (see dotted path in FIG. 2 and FIG. 3) to hold it in place. However, the exterior cloth may be bonded directly to the foam and the foam attached to the receptacle by hook and loop. Other methods may be used to attach the cloth. The fabric may or may not be glued to the foam layer.

Since one of the roles of the curling broom head is to heat the surface of the ice, it would be very advantageous to provide a curling broom that has a broom head that can increase the heat flow into the surface of the ice.

SUMMARY OF THE INVENTION

The present invention provides a curling broom head for improved ice surface heating and curling performance. This curling broom disclosed herein significantly increases the amount of ice surface heating for the same sweeping effort.

An embodiment of the invention includes a curling broom head attachable to a curling broom shaft, comprising:

an attachment plate having a connector for connecting the broom head to an end of a curling broom shaft;

and an outer fabric layer secured to a bottom surface of said attachment plate, wherein an outer surface of said outer fabric layer contacts an ice surface during sweeping motion by the user sweeping an ice surface with the broom; and a reflective constituent selected to reflect infrared radiation incorporated into said curling broom head and located such that when said broom head is swept across the ice surface, infrared radiation generated by said user sweeping the ice is reflected by the reflective constituent back towards said ice surface for further heating up of the ice surface.

The curling broom head may include a foam pad attached to the bottom surface of said attachment plate. The reflective constituent may comprise the outer fabric layer being metalized. The outer fabric being metalized may comprise the outer fabric incorporating metalized powder. The outer fabric being metalized may comprise the outer fabric having a reflective sheet attached to an inner surface thereof.

The reflective constituent may comprise the foam pad being metalized. The foam pad being metalized may comprise the foam pad incorporating metalized powder. The foam pad being metalized may comprise the foam pad having a reflective sheet attached to a bottom surface thereof.

The reflective constituent may comprise a reflective sheet attached to one or both of the bottom surface of the attachment plate and an inner surface of the outer fabric layer.

The reflective constituent may comprise a reflective sheet attached to one or both of a bottom surface of the foam pad and an inner surface of the outer fabric layer.

The foam pad may have a thickness in a range from about 2 mm to about 50 mm.

The attachment plate may have a shape selected from the group consisting of rectangular, circular, elliptical, boomerang and ovoid shapes.

When the attachment plate is ovoid shaped it may have a long axis of about 220 mm, and a short axis of about 65 mm and a thickness of about 10 mm.

The reflective layer may be selected from the group consisting of metal foil or metalized polymer sheet.

The reflective layer may be selected from the group consisting of aluminum foil, silver foil, magnesium foil, gold foil, aluminized Mylar, gold-sputtered Mylar, metalized tape and aluminized polymer sheeting.

The reflective layer may reflect more than about 50% or more of the infrared radiant heat shining upon it.

The curling broom head may be attached to an elongate shaft having opposed first and second ends, the first end being graspable by a sweeper and the second end being releasably attachable to the broom head attachment plate. In this respect the curling broom head may be attached to the broom head attachment plate by any one of a rigid connection, an adjustable pivot joint and an adjustable universal joint.

An embodiment of the present invention provides a curling broom, comprising;

an elongate shaft having opposed first and second ends, the first end being graspable by a sweeper and the second end being attached to a curling broom head for sweeping an ice surface;

a curling broom head including an attachment plate having a connector for connecting the broom head to an end of a curling broom shaft;

an outer fabric layer secured to a bottom surface of the attachment plate, wherein an outer surface of the outer fabric layer contacts an ice surface during sweeping motion by the user sweeping an ice surface with the broom; and a reflective constituent selected to reflect infrared radiation incorporated into the curling broom head and located such that when the broom head is swept across the ice surface, infrared radiation generated by the user sweeping the ice is reflected by the reflective constituent back towards the ice surface for further heating up of the ice surface.

The curling broom head may be attached to the attachment plate by any one of a rigid connection, an adjustable pivot joint or an adjustable universal joint.

A foam layer may optionally be located between the reflective layer and the base section.

A further understanding of the functional and advantageous aspects of the invention can be realized by reference to the following detailed description and drawings.

BRIEF DESCRIPTION OF THE DRAWINGS

The embodiments of the present invention are described with reference to the attached figures, wherein.

DETAILED DESCRIPTION OF THE INVENTION

Generally speaking, the systems described herein are directed to a curling broom head for improved ice surface heating and curling performance. This invention enables curlers to use less abrasive materials than otherwise are typically used to produce heat with the sweeping motion. These less abrasive materials will reduce the amount damage being inflicted on the ice surface with current designs. As required, embodiments of the present invention are disclosed herein. However, the disclosed embodiments are merely exemplary, and it should be understood that the invention may be embodied in many various and alternative forms.

The Figures are not to scale and some features may be exaggerated or minimized to show details of particular elements while related elements may have been eliminated to prevent obscuring novel aspects. Therefore, specific structural and functional details disclosed herein are not to be interpreted as limiting but merely as a basis for the claims and as a representative basis for teaching one skilled in the art to variously employ the present invention. For purposes of teaching and not limitation, the illustrated embodiments are directed to curling broom head for improved ice surface heating and curling performance.

As used herein, the phrases "reflective sheet", "metalized powder", "reflective constituent" all refer to material, whether sheets or powder particles that reflect infrared radiation.

When it is disclosed that a component is metalized it can be accomplished by any one of several ways, incorporating metalized powder, adding a conductive polymer to it, attaching reflective sheets etc. to mention a few.

Figure 1:
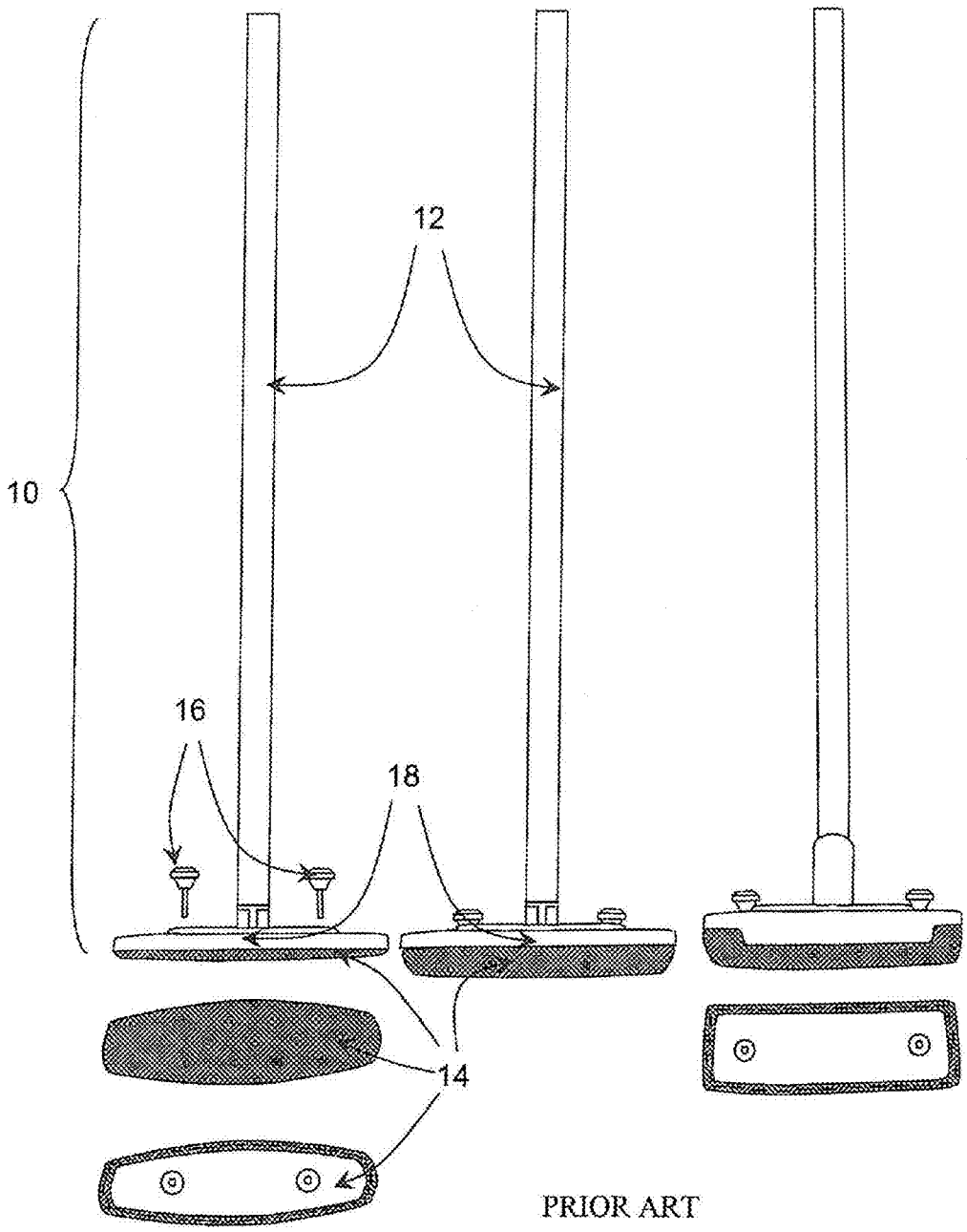
FIG. 1 shows a Prior Art curling broom consisting of a shaft and a removable head that is most commonly attached with two bolts, with three example configurations of the removable head and head attachment plates being shown with differing foam thickness and differing shapes.

FIG. 1 shows a Prior Art curling broom 10 consisting of a shaft and a removable head that is most commonly attached with two bolts, with three example configurations of the removable head and head attachment plates being shown with differing foam thickness and differing shapes.

Curling broom 10 is comprised of a shaft 12 and a removable, replaceable broom head 14. The shaft 12 is held by the curler (not shown) at a first end portion and a broom head attachment plate 18 is attached to the second end portion of the shaft 12. The attachment plate 18 may be attached to the shaft 12 either via a rigid connection, an adjustable pivot joint or an adjustable universal joint (none of which are shown in FIG. 1). Some adjustable joints allow the angle between the shaft 12 and the attachment plate 18 to be set by the curler and tightened so that there is no relative motion between the shaft 12 and attachment plate 18. The replaceable broom head 14 is most commonly attached to the attachment plate 18 via two bolts 16.

Figure 2:
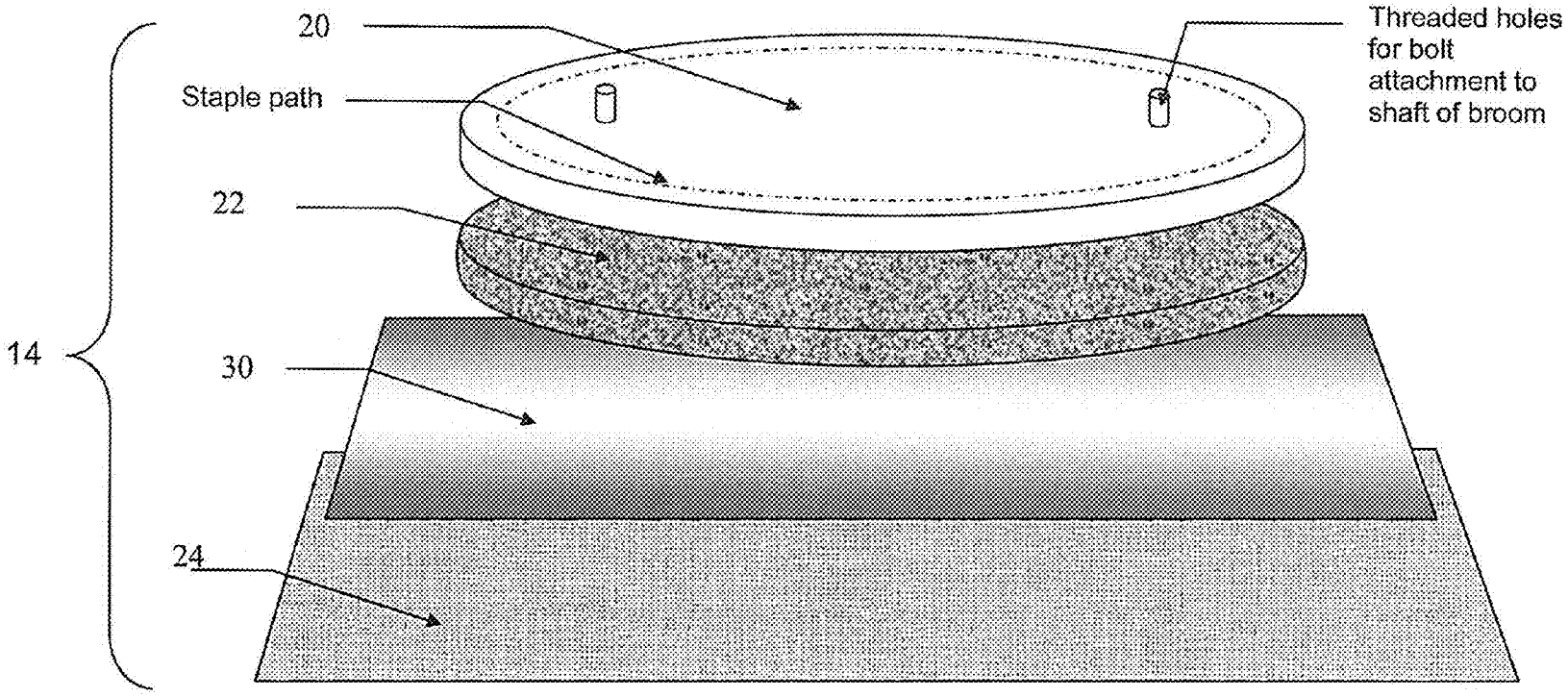
FIG. 2 shows an exploded view of a broom head including a base, an optional foam layer, and fabric playing surface and a reflective layer forming part of the present invention, in which the foam is attached to the base directly and the inventive reflective layer is adhered to the fabric and the foam with the fabric is then attached to the top side of the head base along the dotted path.

The heads of the bolts 16 sit atop the attachment plate 18. Referring to FIG. 2, the broom head 14 is comprised of a base 20 that is usually made of plastic, metal or wood. The bolts 16 pass through the attachment plate 18 and thread into the base 20 of the broom head 14. The base 20 is an ovoid with a long axis of approximately 220 mm, short axis of approximately 65 mm and thickness of 10 mm. Glued or taped to the underside of the base 20 is an optional foam pad 22. This foam pad 22 is for shock absorption and for spreading the head pressure evenly over the ice surface. The foam pad 22, if included in the design, can be made to various densities and thicknesses ranging from 2 mm to 50 mm depending on the preference of the player, or there may be no foam layer at all. The geometry of the foam pad 22 can be simply flat or a more complex three dimensional surface with protrusions, indents or gaps. In the typical broom head, over the foam pad 22 is a layer of woven fabric 24, most often Cordura nylon or other synthetic, polymeric weave. The fabric 24 can be of any color or pattern. The fabric layer 24 is attached to the top-side of the base 20 (see dotted staple path 40 in FIG. 2) to hold it in place. The fabric 24 may or may not be glued to the foam pad 22.

The curling broom forming the present invention includes a reflective constituent, such as reflective layer 30 as shown in FIG. 2. When present, the foam pad 22 is attached to the base 20 directly. The reflective layer 30 is placed between the fabric 24 and the foam layer 30. The reflective layer 30 may be adhered to either the fabric 24 or the foam layer 30 or both. The fabric 24 is then stapled to the top side of the head base along the dotted path mentioned above. In embodiments of the broom head where no foam pad 22 is present, the reflective layer 30 may be attached to base 20 directly.

Figure 3:
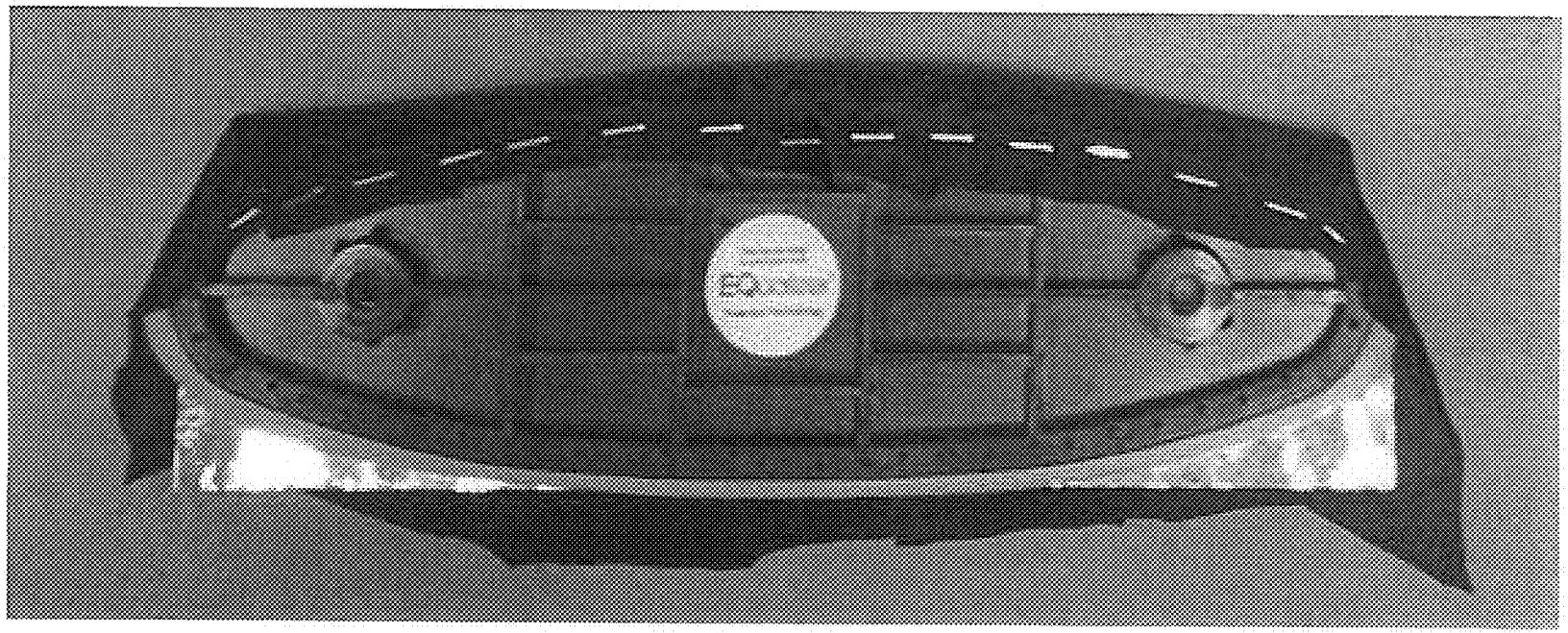
FIG. 3 shows a photograph of the new head design A) taken from the attachment (top) side, B) attachment side with the fabric and reflective layers partially removed and C) from the playing surface side.

FIG. 3 shows a photograph of the present curling broom head design taken from the attachment (top) side, with the fabric layer 24 and reflective layer 30 partially removed and from the playing surface side just showing the fabric layer 24.

Figure 4:
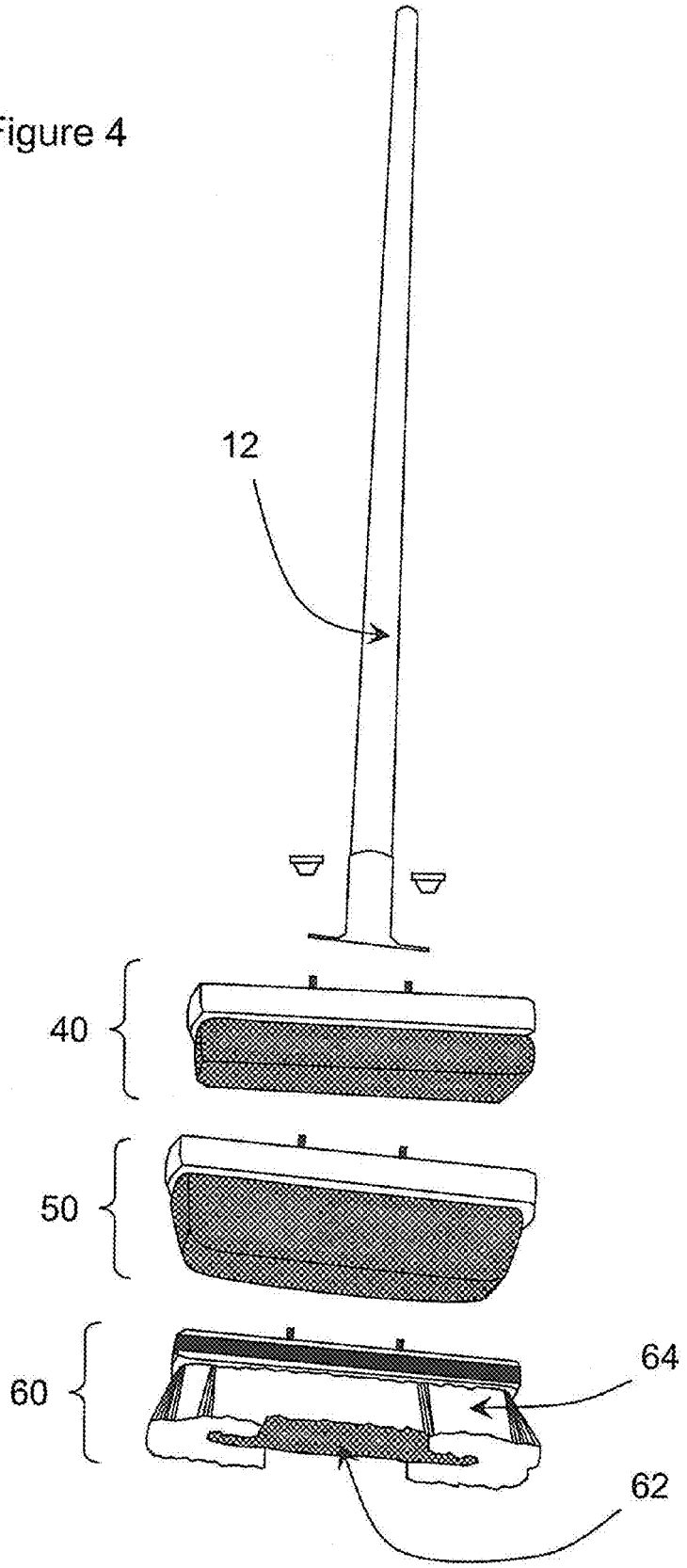
FIG. 4 shows three example configuration of the new removable broom head with the inventive reflective layer integrated inside. The top two heads are the simple construction already described in FIGS. 1, 2 and 3. The third (bottom) broom head is a hybrid of a fabric head in the center surrounded by a hair broom with bristles of either synthetic or natural fibers.

FIG. 4 shows three example configuration of the new removable broom head with the inventive reflective layer 30 integrated inside. The top two heads 40 and 50 are the simple construction already described in FIGS. 1, 2 and 3. The third (bottom) broom head 60 is a hybrid of a fabric head 62 in the center surrounded by a hair broom 64 with bristles of either synthetic or natural fibers.

The reflective layer 30 can be made of metal foil or metalized polymer sheet, just to mentioned a few non-limiting examples. The material selected for the reflective layer 30 should reflect more than 50% of the infrared spectrum light (radiant heat) shining upon it. Non-limiting examples of the reflective layer as a separate sheet include aluminum foil, silver foil, magnesium foil, gold foil, aluminized Mylar, gold-sputtered Mylar, metalized tape and aluminized polymer sheeting.

The reflective layer 30 improves broom performance by reflecting infrared (heat) radiation generated by the friction of the sweeping action back onto the ice surface. Since the heat easily passes through the woven fabric, the reflective layer can be hidden inside the head. This makes the design more robust since the more delicate reflective material of reflective layer 30 is protected from the friction of sweeping by the more durable woven fabric layer 24. By reflecting the heat back onto the ice surface, for the same sweeping exertion by the player, the ice surface is heated more above its ambient temperature than with a conventional curling broom head without the reflective layer 30. Or conversely, the same amount of ice surface heating is possible with the improved curling broom head design disclosed herein for less effort than with a conventional curling broom head. Less abrasive woven fabrics may be used to reduce damage to the playing surface of the ice.

It will be understood the broom head does not need to be an ovoid shape, but could other shapes such as rectangular, elliptical, boomerang or circular just to mention a few non-limiting examples.

It will also be appreciated that the reflective layer does not need to be a separate stand alone sheet. For example, the bottom surface of the foam pad may be metalized with an infrared reflective layer such as silver thread or incorporated into the outer fabric which contacts the ice to give a few non-limiting examples. Also, the foam could be metalized with an infrared reflective constituent, layer or particles embedded in the foam.

As used herein, the terms, "comprises" and "comprising" are to be construed as being inclusive and open ended, and not exclusive. Specifically, when used in this specification including claims, the terms, "comprises" and "comprising" and variations thereof mean the specified features, steps or components are included. These terms are not to be interpreted to exclude the presence of other features, steps or components.

The foregoing description of the preferred embodiments of the invention has been presented to illustrate the principles of the invention and not to limit the invention to the particular embodiment illustrated. It is intended that the scope of the invention be defined by all of the embodiments encompassed within the following claims and their equivalents.

Therefore what is claimed is:

1. A curling broom head attachable to a curling broom shaft, comprising:

a base;

an outer fabric layer through which heat passes secured to said base, wherein an outer surface of said outer fabric layer contacts an ice surface during sweeping motion by a sweeper sweeping an ice surface with the curling broom head; and a reflective constituent including a support substrate and a metalized layer on a surface of said support substrate, said metalized layer forming a reflective surface selected to reflect heat, and said reflective constituent being incorporated into said curling broom head with said reflective surface located in direct contact with an inner surface of said outer fabric to receive all heat passing through said outer fabric such that when said curling broom head is swept across the ice surface, heat generated by said sweeper sweeping the ice surface is reflected by the reflective surface of the metalized layer back through said outer fabric towards the ice surface for further heating of the ice surface.

2. The curling broom head according to claim 1 further including a foam pad attached to said bottom surface of said base.

3. The curling broom head according to claim 2 wherein the foam pad has a thickness in a range from about 2 mm to about 50 mm.

4. The curling broom head according to claim 1 wherein said base has a shape selected from the group consisting of rectangular, circular, elliptical, boomerang and ovoid shapes.

5. The curling broom head according to claim 4 wherein said base is ovoid shaped and has a long axis of about 220 mm, and a short axis of about 65 mm and a thickness of about 10 mm.

6. The curling broom head according to claim 1 wherein the reflective constituent is selected from the group consisting of metal foil, metalized polymer, conducting infrared reflecting polymer sheet and conducting infrared reflecting polymer.

7. The curling broom head according to claim 1 wherein the reflective constituent is selected from the group consisting of aluminum foil, silver foil, magnesium foil, gold foil, aluminized Mylar, gold-sputtered Mylar, metalized tape and aluminized polymer sheeting.

8. The curling broom head according to claim 1 wherein the reflective constituent reflects about 50% or more of the infrared radiant heat shining upon it.

9. The curling broom head according to claim 1 releasibly attached to a bottom surface of a curling broom head attachment plate, and wherein a top surface of said curling broom attachment plate is attached to an elongate shaft which is graspable by the sweeper.

10. The curling broom head according to claim 9 wherein said curling broom head attachment plate is attached to said elongate shaft by any one of a rigid connection, an adjustable pivot joint and an adjustable universal joint.

11. A curling broom, comprising;

an elongate shaft having opposed first and second ends, the first end being graspable by a sweeper and the second end being attached to a top surface of an attachment plate;

a curling broom head including a base secured to a bottom surface of said attachment plate, an outer fabric layer through which heat passes, wherein an outer surface of said outer fabric layer contacts an ice surface during sweeping motion by a sweeper sweeping an ice surface with the curling broom; and a reflective constituent including a support substrate and a metalized layer on a surface of said support substrate, said metalized layer forming a reflective surface selected to reflect heat, and said reflective constituent being incorporated into said curling broom head with said reflective surface located in direct contact with an inner surface of said outer fabric to receive all heat passing through said outer fabric such that when said curling broom head is swept across the ice surface, heat generated by said sweeper sweeping the ice surface is reflected by the reflective surface of the metalized layer back through said outer fabric towards the ice surface for further heating of the ice surface.

12. The curling broom according to claim 11 wherein said curling broom head is attached to said attachment plate by any one of a rigid connection, an adjustable pivot joint or an adjustable universal joint.

13. A curling broom head attachable to a curling broom shaft, comprising:

a base;

an outer fabric layer through which heat passes secured to said base, wherein an outer surface of said outer fabric layer contacts an ice surface during sweeping motion by a sweeper sweeping an ice surface with the curling broom head; and said outer fabric layer including a metalized powder incorporated therein forming a reflective constituent, said reflective constituent selected to reflect infrared located such that when said curling broom head is swept across the ice surface, heat generated by the sweeper sweeping the ice surface is reflected by the reflective constituent back towards the ice surface for further heating of the ice surface.

14. The curling broom head according to claim 13 further including a foam pad attached to said bottom surface of said base.

15. The curling broom head according to claim 14 wherein said foam pad has a thickness in a range from about 2 mm to about 50 mm.

16. The curling broom head according to claim 13 wherein said base has a shape selected from the group consisting of rectangular, circular, elliptical, boomerang and ovoid shapes.

17. The curling broom head according to claim 13 wherein said base is ovoid shaped and has a long axis of about 220 mm, and a short axis of about 65 mm and a thickness of about 10 mm.

18. The curling broom head according to claim 13 being releasibly attached to a bottom surface of a curling broom head attachment plate, and wherein a top surface of said curling broom head attachment plate is attached to one end of an elongate shaft, said elongate shaft being graspable by the sweeper.

19. The curling broom head according to claim 18 wherein said curling broom head attachment plate is connected to said elongate shaft by any one of a rigid connection, an adjustable pivot joint and an adjustable universal joint.

20. A curling broom head attachable to a curling broom shaft, comprising:

a base having a top and bottom surface;

an outer fabric layer through which heat passes secured to said base, wherein an outer surface of said outer fabric layer contacts an ice surface during sweeping motion by a sweeper sweeping the ice surface with the curling broom head;

a metalized foam pad attached to said bottom surface of said base inside said outer fabric layer, said metalized foam pad forming a reflective constituent selected to reflect heat, said reflective constituent including said foam pad incorporating metalized powder, said metalized foam pad being located such that when said curling broom head is swept across the ice surface, heat generated by a sweeper sweeping the ice surface is reflected by the reflective constituent back towards the ice surface for further heating up the ice surface.

21. The curling broom head according to claim 20 wherein said foam pad has a thickness in a range from about 2 mm to about 50 mm.

22. The curling broom head according to claim 20 wherein said base has a shape selected from the group consisting of rectangular, circular, elliptical, boomerang and ovoid shapes.

23. The curling broom head according to claim 20 wherein said base is ovoid shaped and has a long axis of about 220 mm, and a short axis of about 65 mm and a thickness of about 10 mm.

24. The curling broom head according to claim 20 being releasibly attached to a bottom surface of a curling broom head attachment plate, and wherein a top surface of said curling broom head attachment plate is attached to one end of an elongate shaft, said elongate shaft being graspable by the sweeper.

25. The curling broom head according to claim 24 wherein said curling broom head attachment plate is connected to said elongate shaft by any one of a rigid connection, an adjustable pivot joint and an adjustable universal joint.

* * * * *